US006783469B2

(12) United States Patent
Iwami

(10) Patent No.: US 6,783,469 B2
(45) Date of Patent: Aug. 31, 2004

(54) MULTI-PIECE SOLID GOLF BALL

(75) Inventor: Satoshi Iwami, Kobe (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 0 days.

(21) Appl. No.: 10/621,521

(22) Filed: Jul. 18, 2003

(65) Prior Publication Data

US 2004/0018893 A1 Jan. 29, 2004

(30) Foreign Application Priority Data

Jul. 24, 2002 (JP) ..... 2002-215231

(51) Int. Cl.[7] ..... A63B 37/06
(52) U.S. Cl. ..... 473/377
(58) Field of Search ..... 473/351, 367, 473/368, 370, 371, 373, 374, 377, 378

(56) References Cited

U.S. PATENT DOCUMENTS 5,948,862 A 9/1999 Sano et al.
6,106,415 A 8/2000 Masutani et al.
2002/0053761 A1 * 5/2002 Dalton ..... 264/574
2004/0058750 A1 * 3/2004 Iwami ..... 473/371

FOREIGN PATENT DOCUMENTS

JP 10-174728 A 6/1998
JP 10-179795 A 7/1998
JP 2000-70409 A 3/2000

* cited by examiner

*Primary Examiner*—Raeann Gorden
(74) *Attorney, Agent, or Firm*—Birch, Stewart, Kolasch & Birch, LLP

(57) ABSTRACT

The present invention provides a multi-piece solid golf ball, which is superior in rebound characteristics, flight performance and durability, while maintaining good productivity. The present invention relates to a multi-piece solid golf ball comprising a core, an intermediate layer formed on the core and a cover covering the intermediate layer, wherein the intermediate layer is formed from an intermediate layer composition comprising a functional group modified resin as a main component, the cover is formed from a cover composition comprising a resin having polar site that can react with the functional group of the functional group modified resin in the intermediate layer as a main component, and a hardness of the intermediate layer is lower than that of the cover.

3 Claims, 1 Drawing Sheet

MULTI-PIECE SOLID GOLF BALL

FIELD OF THE INVENTION

The present invention relates to a multi-piece solid golf ball. More particularly, it relates to a multi-piece solid golf ball, which is superior in rebound characteristics, flight performance and durability, while maintaining good productivity.

BACKGROUND OF THE INVENTION

In golf balls commercially selling, there are solid golf balls such as two-piece golf ball, three-piece golf ball and the like, and thread wound golf balls. Recently, the two-piece golf ball and three-piece golf ball, of which flight distance can be improved while maintaining soft and good shot feel at the time of hitting as good as the conventional thread wound golf ball, generally occupy the greater part of the golf ball market. Multi-piece golf balls represented by the three-piece golf ball have good shot feel while maintaining excellent flight performance, because they can vary hardness distribution, when compared with the two-piece golf ball.

The three-piece solid golf balls are obtained by inserting an intermediate layer between the core and the cover layer constituting the two-piece solid golf ball, and have been described in Japanese Patent Kokai Publication Nos. 174728/1998, 70409/2000 and the like. In the golf balls, it has been attempted to compromise the balance of flight performance and shot feel at the time of hitting by using thermoplastic resin, such as ionomer resin, thermoplastic elastomer, functional group modified thermoplastic elastomer or mixtures thereof for the intermediate layer, to adjust a hardness, hardness distribution and the like of the core, intermediate layer and cover to proper ranges.

In Japanese Patent Kokai publication No. 174728/1998, a multi-piece solid golf ball comprising a core, at least one layer of an intermediate layer and a cover, of which at least one layer of the intermediate layer is formed from as a main component heated mixture of at least two components selected from three components consisting of ionomer resin, thermoplastic elastomer having a terminal OH group, and styrene-butadiene-styrene block copolymer or styrene-isoprene-styrene block copolymer having an epoxy group, and the intermediate layer has a hardness in JIS-C hardness of 40 to 80, and a hardness difference from the center to the surface of the core is not more than 15, is disclosed.

In Japanese Patent Kokai publication No. 70409/2000, a multi-piece solid golf ball obtained by inserting at least one layer of an intermediate layer between a solid core and at least one layer of a cover, of which the intermediate layer is formed from as a main component thermoplastic resin having a Shore D hardness of 8 to 35 and the cover is formed from a cover material comprising thermoplastic resin as a main component and inorganic filler, and the Shore D hardness of the cover is higher than that of the intermediate layer by not less than 25.

In the above conventional golf balls, since the adhesion between the intermediate layer and cover is not sufficiently obtained, the adhesion is improved by roughing the surface of the intermediate layer, such as abrading the surface after forming the intermediate layer to form the cover thereon. However, the adhesion between the intermediate layer and cover is not sufficiently obtained yet by only the method, and it is problem that the durability is degraded because of the loss of the rebound characteristics and spin amount of the resulting golf ball.

In order to solve the problem, it has been attempted to interposing an adhesive layer between the intermediate layer and cover to improve the adhesion therebetween (Japanese Patent Kokai publication No. 179795/1998). The adhesion between the intermediate layer and cover is improved, but it is problem that a process of forming the cover on the intermediate layer is complicated to degrade the productivity. Therefore, it is required to provide a golf ball having better rebound characteristics, better flight performance and better durability while maintaining good productivity.

OBJECTS OF THE INVENTION

A main object of the present invention is to provide a multi-piece solid golf ball, which is superior in rebound characteristics, flight performance and durability, while maintaining good productivity.

According to the present invention, the object described above has been accomplished by providing a multi-piece solid golf ball comprising a core, an intermediate layer and an cover; using a functional group modified resin as a base resin for the intermediate layer; using a reactive resin with the functional group of the functional group modified resin in the intermediate layer as a base resin for the cover; and adjusting a hardness of the intermediate layer to be lower than that of the cover; thereby providing a multi-piece solid golf ball, which is superior in rebound characteristics, flight performance and durability, while maintaining good productivity.

This object as well as other objects and advantages of the present invention will become apparent to those skilled in the art from the following description with reference to the accompanying drawings.

BRIEF EXPLANATION OF DRAWINGS

The present invention will become more fully understood from the detailed description given hereinbelow and the accompanying drawings which are given by way of illustration only, and thus are not limitative of the present invention, and wherein.

SUMMARY OF THE INVENTION

Figure 1:
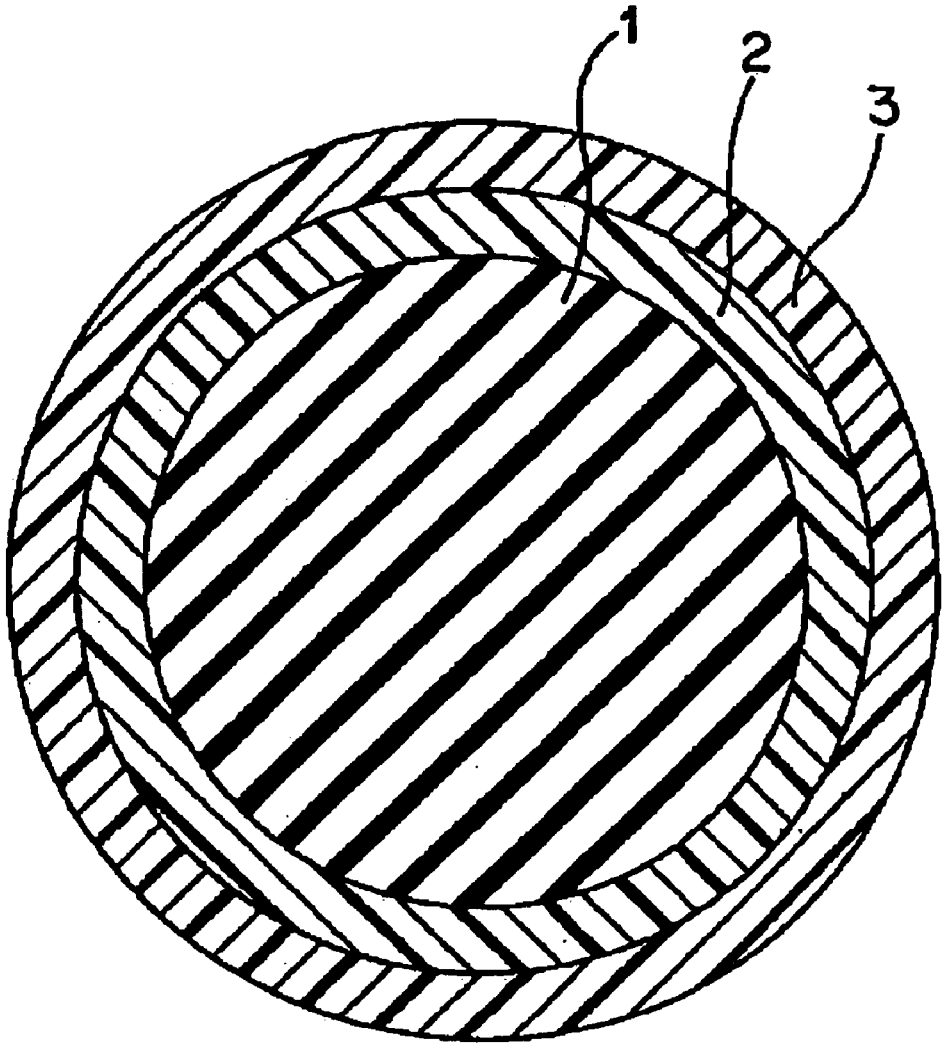
FIG. 1 is a schematic cross section illustrating one embodiment of the golf ball of the present invention.

The present invention provides a multi-piece solid golf ball comprising a core, an intermediate layer formed on the core and a cover covering the intermediate layer, wherein

- the intermediate layer is formed from an intermediate layer composition comprising a functional group modified resin as a main component,
- the cover is formed from a cover composition comprising a resin having polar site that can react with the functional group of the functional group modified resin in the intermediate layer as a main component, and
- a hardness of the intermediate layer is lower than that of the cover.

In order to put the present invention into a more suitable practical application, it is preferable that

- the functional group modified resin be a functional group modified polyester-based thermoplastic elastomer; and
- the functional group of the functional group modified resin be selected from the group consisting of isocyanate group, epoxy group, acid group, hydroxyl group and anhydride group.

DETAILED DESCRIPTION OF THE INVENTION

The multi-piece solid golf ball of the present invention will be explained with reference to the accompanying drawing in detail. FIG. 1 is a schematic cross section illustrating one embodiment of the multi-piece solid golf ball of the present invention. As shown in FIG. 1, the golf ball of the present invention comprises a core 1, an intermediate layer 2 formed on the core 1, and an cover 3 covering the intermediate layer. In the golf ball of the present invention, the core 1 may have single-layer structure or multi-layer structure, which has two or more layers. However, in order to explain the golf ball of the present invention simply, a golf ball having one layer of core 1, that is, a three-piece solid golf ball, will be used hereinafter for explanation.

The core is obtained by press-molding a rubber composition under applied heat by using a method and condition, which has been conventionally used for preparing solid cores of golf balls. The rubber composition contains a base rubber, a co-crosslinking agent, an organic peroxide, a filler and the like.

The base rubber used for the core of the present invention may be synthetic rubber, which has been conventionally used for cores of solid golf balls. Preferred is high-cis polybutadiene rubber containing a cis-1, 4 bond of not less than 40%, preferably not less than 80%. The high-cis polybutadiene rubber may be optionally mixed with natural rubber, polyisoprene rubber, styrene-butadiene rubber, ethylene-propylene-diene rubber (EPDM) and the like.

The co-crosslinking agent can be a metal salt of α,β-unsaturated carboxylic acid, including mono or divalent metal salts, such as zinc or magnesium salts of α,β-unsaturated carboxylic acids having 3 to 8 carbon atoms (e.g. acrylic acid, methacrylic acid, etc.). When the core has two-layered structure composed of an inner core and outer core and the outer core is thin, the preferred co-crosslinking agent for the inner core is a zinc salt of α,β-unsaturated carboxylic acid, particularly zinc acrylate, because it imparts high rebound characteristics to the resulting golf ball, and the preferred co-crosslinking agent for the outer core is a magnesium salt of α,β-unsaturated carboxylic acid, particularly magnesium methacrylate because it imparts good releasability from a mold to the core. The amount of the co-crosslinking agent is from 15 to 45 parts by weight, preferably from 25 to 40 parts by weight, based on 100 parts by weight of the base rubber. When the amount of the co-crosslinking agent is smaller than 15 parts by weight, the core is too soft, and the rebound characteristics are degraded, which reduces the flight distance. On the other hand, when the amount of the co-crosslinking agent is larger than 45 parts by weight, the core is too hard, and the shot feel of the resulting golf ball is poor.

The organic peroxide, which acts as a crosslinking agent or curing agent, includes, for example, dicumyl peroxide, 1,1-bis (t-butylperoxy)-3,3,5-trimethylcyclohexane, 2,5-dimethyl-2,5-di(t-butylperoxy) hexane, di-t-butyl peroxide and the like. The preferred organic peroxide is dicumyl peroxide. The amount of the organic peroxide is from 0.05 to 3 parts by weight, preferably 0.1 to 1.5 parts by weight, based on 100 parts by weight of the base rubber. When the amount of the organic peroxide is smaller than 0.05 parts by weight, the core is too soft, and the rebound characteristics of the resulting golf ball are degraded, which reduces the flight distance. On the other hand, when the amount of the organic peroxide is larger than 3 parts by weight, the core is too hard, and the shot feel of the resulting golf ball is poor.

The filler, which can be typically used for the core of solid golf ball, includes for example, inorganic filler (such as zinc oxide, barium sulfate, calcium carbonate, magnesium oxide and the like), high specific gravity metal powder filler (such as tungsten powder, molybdenum powder and the like), and the mixture thereof. The amount of the filler is from 1 to 30 parts by weight, preferably from 5 to 20 parts by weight, based on 100 parts by weight of the base rubber. When the amount of the filler is smaller than 1 part by weight, it is difficult to adjust the specific gravity of the core, and it is difficult to adjust the weight of the resulting golf ball to a proper range. On the other hand, when the amount of the filler is larger than 30 parts by weight, the rubber content in the core is small, and the rebound characteristics are degraded.

The rubber compositions for the core of the golf ball of the present invention can contain other components, which have been conventionally used for preparing the core of solid golf balls, such as organic sulfide compound, antioxidant and the like. If used, the amount of the organic sulfide compound is preferably 0.2 to 5.0 parts by weight, based on 100 parts by weight of the base rubber.

The core of the golf ball of the present invention can be obtained by uniformly mixing the rubber composition, and then press-molding and vulcanizing the mixture under applied heat in a mold. The vulcanizing, of which the condition is not limited, is conducted at 130 to 180° C. and 2.9 to 11.8 MPa for 10 to 40 minutes.

When the core has multi-layered structure, such as two-layered structure composed of the inner core and outer core, the both layers are preferably formed from the above rubber composition, but a material for the outer core is not limited as long as it has the above properties. That is, the outer core may be formed from the above rubber composition comprising cis-1,4-polybutadiene as a base rubber, or from thermoplastic resin, such as ionomer resin, thermoplastic elastomer or mixture thereof.

In the golf ball of the present invention, it is suitable for the core to have a diameter of 32.0 to 41.0 mm, preferably 34.2 to 40.4 mm, more preferably 35.2 to 39.4 mm. When the diameter of the core is smaller than 32.0 mm, it is required to increase the thickness of the intermediate layer or cover, and the rebound characteristics of the resulting golf ball are degraded. On the other hand, when the diameter is larger than 41.0 mm, it is required to reduce the thickness of the intermediate layer or cover, and the technical effects accomplished by the presence of the intermediate layer and cover are not sufficiently obtained.

In the golf ball of the present invention, it is desired for the core to have a deformation amount when applying from an initial load of 98 N to a final load of 1275 N of 2.8 to 4.5 mm, preferably 3.0 to 4.2 mm, more preferably 3.2 to 3.8 mm. When the deformation amount is smaller than 2.8 mm, the core is too hard, and the shot feel of the resulting golf ball is hard and poor. In addition, the spin amount is large, which reduces the flight distance. On the other hand, when the deformation amount is larger than 4.5 mm, the deformation amount of the core at the time of hitting is too large, and the shot feel of the resulting golf ball is heavy and poor. In addition, the rebound characteristics of the resulting golf ball are poor.

In the golf ball of the present invention, it is desired for the core 1 to have a surface hardness in Shore D hardness of 30 to 75, preferably 35 to 65, more preferably 38 to 55. When the surface hardness is lower than 30, the shot feel of the resulting golf ball is heavy and poor. On the other hand, when the surface hardness is higher than 75, the shot feel of the resulting golf ball is hard and poor. The term "a surface hardness of the core" as used herein refers to the hardness, which is determined by measuring a hardness at the surface of the core prepared by press molding and vulcanizing as described above, that is, at the surface of the core before covering with the intermediate layer.

In the golf ball of the present invention, if the core has multi-layered structure, such as two-layered structure composed of an inner core and an outer core, it is desired that the diameter, deformation amount and surface hardness of the resulting two-layered core be within the above ranges. A method of producing the two-layered core is not specifically limited, but may be a conventional method. The spherical inner core can be obtained by mixing the rubber composition for the inner core, and then press-molding and vulcanizing the mixture at the above vulcanization condition in a mold. The two-layered core, which is formed by covering the outer core on the inner core, can be obtained by mixing the rubber composition for the outer core is mixed, coating the mixture on the inner core into a concentric sphere, and then press-molding at 160 to 180° C. for 10 to 20 minutes in the mold. The intermediate layer 2 is then covered on the core 1.

In the golf ball of the present invention, it is desired for the intermediate layer 2 to have a thickness of 0.4 to 2.9 mm, preferably 0.4 to 2.0 mm, more preferably 0.7 to 1.6 mm. When the thickness of the cover is smaller than 0.4 mm, the technical effects accomplished by the presence of the intermediate layer are not sufficiently obtained, and the shot feel of the resulting golf ball is hard and poor. On the other hand, when the thickness is larger than 2.9 mm, the rebound characteristics are degraded, which reduces the flight distance. In addition, the launch angle is small and the spin amount is large, which reduces the flight distance.

In the golf ball of the present invention, it is required for the intermediate layer to have a hardness in Shore D hardness of 10 to 60, preferably 15 to 55, more preferably 18 to 50. When the hardness of the intermediate layer is lower than 10, the intermediate layer is too soft, and the rebound characteristics and durability of the resulting golf ball are degraded. On the other hand, when the hardness of the intermediate layer is higher than 60, the shot feel is hard and poor. The term "a hardness of the intermediate layer" as used herein refers to the hardness, which is determined by measuring a hardness (slab hardness), using a sample of a stack of the three or more heat and press molded sheets having a thickness of about 2 mm from the intermediate layer composition, which had been stored at 23° C. for 2 weeks.

In the golf ball of the present invention, it is required for the intermediate layer 2 to be formed from a resin composition comprising a functional group modified resin as a main component. Examples of the functional group modified resins, of which the backbone resin is not limited as long as the resin is modified by functional group, include thermoplastic resin modified by functional group, such as thermoplastic elastomer modified by functional group, and the like. The examples may include ionomer resin and the like. Examples of the backbone resins of the thermoplastic resin modified by functional group include thermoplastic elastomers, such as polyester-based thermoplastic elastomer, polyurethane-based thermoplastic elastomer, polyamide-based thermoplastic elastomer, styrene-based thermoplastic elastomer, polyolefin-based thermoplastic elastomer; polyolefin resins and the like. As the functional group modified resin, preferred are ionomer resin and a functional group modified polyester-based thermoplastic elastomer in view of rebound characteristics. It is desired that the functional group of the functional group modified resin be selected from the group consisting of isocyanate group, epoxy group, acid group, hydroxyl group and anhydride group. Concrete examples of the functional group modified resins include epoxy modified polyester-based thermoplastic elastomer, isocyanate modified polyester-based thermoplastic elastomer, epoxy modified styrene-based thermoplastic elastomer, epoxy modified polyolefin-based thermoplastic elastomer, epoxy modified polyolefin resin and the like. The wording "comprising the functional group modified resin as a main component" used herein means that the amount of the resin is not less than 50% by weight, preferably not less than 80% by weight, more preferably not less than 90% by weight.

The intermediate layer 2 of the present invention may be formed by conventional methods, which have been known to the art and used for forming the cover of the golf balls. For example, there can be used a method comprising molding the intermediate layer composition into a semi-spherical half-shell in advances covering the core with the two half-shells, followed by pressure molding at 130 to 170° C. for 1 to 5 minutes, or a method comprising injection molding the intermediate layer composition directly on the core to cover it.

The cover 3 is then covered on the intermediate layer 2. It is required for the cover 3 of the present invention to be formed from a cover composition comprising a resin having polar site that can react with the functional group of the functional group modified resin in the intermediate layer as a main component. Examples of the resins include ionomer resin (carboxyl group), polyurethane-based thermoplastic elastomer (urethane bond), polyester-based thermoplastic elastomer (ester bond), polyamide-based thermoplastic elastomer (amide bond), polyurethane-based thermosetting elastomer (urethane bond), thermosetting polyurea (urea bond) or mixtures thereof. Preferred is ionomer resin in view of rebound characteristics, and preferred is polyurethane-based thermoplastic elastomer in view of spin performance. In the present invention, the base resin of the cover resin composition may contain the other resins, such as polyolefin resin, polystyrene resin, in addition to the resin component.

In the golf ball of the present invention, it is required for the cover 3 to be formed from a cover composition comprising a resin having polar site that can react with the functional group of the functional group modified resin in the intermediate layer as a main component. Among the combinations of the intermediate layer 2 and the cover 3 (intermediate layer/cover), preferred are epoxy group modified resin/ionomer resin, isocyanate group modified resin/polyurethane-based thermoplastic elastomer and the like. The wording "comprising the resin as a main component" used herein means that the amount of the resin is not less than 50% by weight, preferably not less than 80% by weight, more preferably not less than 90% by weight.

In the golf ball of the present invention, the cover composition may optionally contain pigments (such as titanium dioxide, etc.), and other additives (such as a dispersant, an antioxidant, a UV absorber, a photostabilizer and a fluorescent agent or a fluorescent brightener, etc.), in addition to the resin component. If used, the amount of the pigment is 0.1 to 5 parts by weight, based on 100 parts by weight of the base resin for the cover.

The cover 3 of the present invention may be formed by conventional methods, which have been known to the art and used for forming the cover of the golf balls. For example, there can be used a method comprising molding the cover composition into a semi-spherical half-shell in advance, covering the intermediate layer coated core with the two half-shells, followed by pressure molding at 160 to 200° C. for 1 to 10 minutes, or a method comprising injection molding the cover composition directly on the intermediate layer coated core to cover it. Preferred is the method comprising injection molding in view of moldability.

In the golf ball of the present invention, it is desired for the cover 3 to have a thickness of 0.5 to 2.5 mm, preferably 0.8 to 2.3 mm, more preferably 1.0 to 2.0 mm. When the thickness is smaller than 0.5 mm, the rebound characteristics are degraded, which reduces the flight performance. In addition, the durability is degraded. On the other hand, when the thickness is larger than 2.5 mm, the shot feel is hard and poor.

In the golf ball of the present invention, it is required that the hardness (a) of the intermediate layer 2 be lower than the hardness (b) of the cover 3, and the hardness difference (b–a) in Shore D hardness is preferably 3 to 60, more preferably 5 to 50. When the hardness difference is not more than 0, the spin amount at the time of hitting is too large, which reduces the flight distance.

In the golf ball of the present invention, it is desired for the cover 3 to have a hardness in Shore D hardness of not less than 50, preferably 50 to 70, more preferably 55 to 68. When the hardness is lower than 50, the spin amount at the time of hitting is large, which reduces the flight distance. On the other hand, when the hardness is higher than 70, the shot feel of the resulting golf ball is hard and poor. The term "hardness of the cover 3" refer to the hardness, which is measured by using a sample of heat and press molded sheet prepared from the cover composition.

At the time of molding the cover, many depressions called "dimples" are formed on the surface of the golf ball. Furthermore, paint finishing or marking with a stamp may be optionally provided after the cover is molded.

In the golf ball of the present invention, it is desired to have a deformation amount when applying from an initial load of 98 N to a final load of 1275 N of 2.7 to 4.0 mm, preferably 2.8 to 3.8 mm, more preferably 2.9 to 3.5 mm. When the deformation amount is smaller than 2.7 mm, the shot feel is hard and poor. On the other hand, when the deformation amount is larger than 4.0 mm, the deformation amount of the golf ball at the time of hitting is too large, and the shot feel is heavy and poor.

The golf ball of the present invention is formed, so that it has a diameter of not less than 42.67 mm (preferably 42.67 to 43 mm) and a weight of not more than 45.93 g, in accordance with the regulations for golf balls.

The diameter of golf balls is limited to not less than 42.67 mm in accordance with the regulations for golf balls as described above. Generally, when the diameter of the golf ball is large, air resistance of the golf ball on a flight is large, which reduces the flight distance. Therefore, most of golf balls commercially available are designed to have a diameter of 42.67 to 42.82 mm. The present invention is applicable to the golf balls having the diameter. There are golf balls having large diameter in order to improve the easiness of hitting. In addition, there are cases where golf balls having a diameter out of the regulations for golf balls are required depending on the demand and object of users. Therefore, it can be considered for golf balls to have a diameter of 42 to 44 mm, more widely 40 to 45 mm. The present invention is also applicable to the golf balls having the diameter. In addition, the golf ball of the present invention has a weight of 44 to 46 g, preferably 45.00 to 45.93 g.

EXAMPLES

The following Examples and Comparative Examples further illustrate the present invention in detail but are not to be construed to limit the scope of the present invention.

Production of Core

The rubber compositions for the core having the formulations shown in Table 1 were mixed, and then vulcanized by press-molding at the vulcanization condition shown in the same Table in a mold to obtain spherical cores. The diameter, surface hardness and deformation amount of the resulting core were measured. The results are shown in Table 1, Table 4 (Examples) and Table 5 (Comparative Examples). The test methods are described later.

TABLE 1

| | | (parts by weight) | | | | | | |
|---|---|---|---|---|---|---|---|---|
| Core composition | | A | B | C | D | E | F | G |
| BR11 *1 | | 100 | 100 | 100 | 100 | 100 | 100 | 100 |
| Zinc acrylate | | 32.0 | 25.0 | 25.0 | 25.0 | 25.0 | 25.0 | 28.0 |
| Zinc oxide | | 18.0 | 22.0 | 8.0 | 19.5 | 10.5 | 23.5 | 27.0 |
| Dicumyl peroxide *2 | | 0.6 | 0.9 | 0.9 | 0.9 | 0.9 | 0.9 | 0.6 |
| Diphenyl disulfide *3 | | 1.0 | — | — | — | — | — | 0.5 |
| Vulcanization condition | | | | | | | | |
| The first stage | Temp. (° C.) | 146 | 155 | 155 | 155 | 155 | 155 | 142 |
| | Time (min) | 24 | 21 | 21 | 21 | 21 | 21 | 22 |
| The second stage | Temp. (° C.) | 162 | — | — | — | — | — | 160 |
| | Time (min) | 6 | — | — | — | — | — | 7 |
| Diameter (mm) | | 39.4 | 38.0 | 38.0 | 38.0 | 38.0 | 38.0 | 35.2 |
| Surface hardness (Shore D) | | 39 | 50 | 50 | 50 | 50 | 50 | 44 |
| Deformation mount (mm) | | 3.50 | 3.65 | 3.65 | 3.65 | 3.65 | 3.65 | 3.70 |

*1: High-cis Polybutadiene rubber (trade name "BR11") available from JSR Co., Ltd. (Content of 1,4-cis-polybutadiene: 96%)
*2: Dicumyl peroxide, commercially available from Nippon Oil & Fats Co., Ltd. under the trade name of "Percumyl D"
*3: Diphenyl disulfide commercially available from Sumitomo Seika Co., Ltd.

Preparation of Compositions for Intermediate Layer and Cover

The formulation materials for the intermediate layer showed in Table 2 and formulation materials for the cover showed in Table 3 were respectively mixed using a kneading type twin-screw extruder to obtain pelletized compositions for the intermediate layer and cover. The extrusion condition was, a screw diameter of 45 mm, a screw speed of 200 rpm, and a screw L/D of 35.

The formulation materials were heated at 160 to 260° C. at the die position of the extruder. The intermediate layer hardness and the cover hardness were determined by measuring a Shore D hardness, using a sample of a stack of the three or more heat and press molded sheets having a thickness of about 2 mm from the compositions for the intermediate layer and the cover. The results are shown in Tables 4 to 5 as the intermediate layer hardness and cover hardness.

TABLE 2

| Intermediate layer Composition | (parts by weight) a | b | c | d |
|---|---|---|---|---|
| Epoxy modified polyester-based thermoplastic elastomer-1 *4 | 100 | — | — | — |
| Epoxy modified polyester-based thermoplastic elastomer-2 *5 | | 100 | — | — |
| Isocyanate modified polyester-based thermoplastic elastomer *6 | — | — | 100 | |
| Perprene P40H *7 | — | — | — | 100 |

*4: Epoxy modified polyester-based thermoplastic elastomer commercially available from Toyobo Co., Ltd., Shore D hardness: 20

*5: Epoxy modified polyester-based thermoplastic elastomer commercially available from Toyobo Co., Ltd., Shore D hardness: 40

*6: Isocyanate modified polyester-based thermoplastic elastomer commercially available from Toyobo Co., Ltd., Shore D hardness: 50

*7: Perprene P40H (trade name), polyester-based thermoplastic elastomer (unmodified) commercially available from Toyobo Co., Ltd., Shore D hardness: 38

TABLE 3

| Cover composition | I | II | III | IV | V |
|---|---|---|---|---|---|
| Surlyn 8945 *8 | 50 | — | — | — | — |
| Surlyn 9945 *9 | 50 | — | — | — | — |
| Surlyn 8140 *10 | — | 50 | — | — | — |
| Surlyn 9120 *11 | — | 50 | — | — | — |
| Pandex T1190 *12 | — | — | 100 | — | — |
| Elastollan ET115D *13 | — | — | — | 100 | — |
| Polypropylene *14 | — | — | — | — | 100 |
| Titanium dioxide | 4 | 4 | 4 | 4 | 4 |

*8: Surlyn 8945 (trade name), ethylene-methacrylic acid copolymer ionomer resin obtained by neutralizing with sodium ion, manufactured by Du Pont Co., Shore D hardness: 65

*9: Surlyn 9945 (trade name), ethylene-methacrylic acid copolymer ionomer resin obtained by neutralizing with zinc ion, manufactured by Du Pont Co., Shore D hardness: 64

*10: Surlyn 8140 (trade name), ethylene-methacrylic acid copolymer ionomer resin obtained by neutralizing with sodium ion, manufactured by Du Pont Co., Shore D hardness: 68

*11: Surlyn 9120 (trade name), ethylene-methacrylic acid copolymer ionomer resin obtained by neutralizing with zinc ion, manufactured by Du Pont Co., Shore D hardness: 69

*12: Pandex T1190 (trade name), polyurethane-based thermoplastic elastomer, which is commercially available from DIC Bayer Polymer Ltd., JIS-A hardness: 90

*13: Elastollan ET115D (trade name), polyurethane-based thermoplastic elastomer, which is commercially available from BASF Japan Co., Ltd., Shore D hardness: 55

*14: Polypropylene, which is commercially available from Japan Polychem Corporation, Shore D hardness: 66

Formation of Intermediate Layer

The resulting composition for the intermediate layer was directly injection-molded on the core to form an intermediate layer having the thickness shown in Table 4 (Examples) and Table 5 (Comparative Examples).

Examples 1 to 5 and Comparative Examples 1 to 5

The resulting composition for the cover was covered on the intermediate layer by directly injection molding to form a cover layer having the thickness shown in Table 4 (Examples) and Table 5 (Comparative Examples). Then, clear paint was coated on the surface of the cover layer after deflashing to obtain a golf ball having a diameter of 42.8 mm and a weight of 45.4 g. With respect to the resulting golf balls, the deformation amount, coefficient of restitution, flight performance (launch angle, spin amount and flight distance) and durability were measured or evaluated. The results are shown in Table 6 (Examples) and Table 7 (Comparative Examples). The test methods are as follows.

(Test Method)

(1) Deformation Amount

The deformation amount of core or golf ball was determined by measuring a deformation amount when applying from an initial load of 98 N to a final load of 1275 N on the core or golf ball.

(2) Intermediate Layer and Cover Hardness

The hardness of the intermediate layer or cover was determined by measuring a Shore D hardness (slab hardness), using a sample of a stack of the three or more heat and press molded sheets having a thickness of about 2 mm from the intermediate layer composition or cover composition, which had been stored at 23° C. for 2 weeks. The Shore D hardness was measured by using an automatic rubber hardness tester (type LA1), which is commercially available from Kobunshi Keiki Co., Ltd., with a Shore D hardness meter according to ASTM D 2240.

(3) Coefficient of Restitution

A cylindrical aluminum projectile having weight of 200 g was struck at a speed of 45 m/sec against a golf ball, and the velocity of the projectile and the golf ball before and after the strike were measured. The coefficient of restitution of the golf ball was calculated from the velocity and the weight of both the projectile and the golf ball. The measurement was conducted 5 times for each golf ball (n=5), with the mean value being taken as the coefficient of restitution of each ball and expressed as an index, with the value of the index in Example 4 being taken as 100. A higher index corresponded to a higher rebound characteristic, and thus a good result.

(4) Flight Performance

A No. 1 wood club (W#1, a driver) having metal head was mounted to a swing robot manufactured by True Temper Co. and the resulting golf ball was hit at a head speed of 40 m/second, the launch angle, spin amount (backspin amount) immediately after hitting, and flight distance were measured. As the flight distance, total that is a distance to the stop point of the hit golf ball was measured. The measurement was conducted 12 times for each golf ball (n=12), and the average is shown as the result of the golf ball and is expressed as an index, with the value of the index in Example 4 being taken as 100.

(5) Durability

A No. 1 wood club (W#1, a driver) having metal head was mounted to a swing robot manufactured by True Temper Co. and the resulting golf ball was hit at a head speed of 45 m/second to strike against an impact board, repeatedly. The durability is determined by measuring the number of hit until the cover of the golf ball cracks, and is expressed as an index, with the value of the index in Example 5 being taken as 100. The larger the value is, the better durability the golf ball has.

(Test Results)

TABLE 4

| Test item | Example No. 1 | 2 | 3 | 4 | 5 |
|---|---|---|---|---|---|
| (Core) | | | | | |
| Composition | A | B | B | C | G |
| Diameter (mm) | 39.4 | 38.0 | 38.0 | 38.0 | 35.2 |
| (Intermediate layer) | | | | | |
| Composition | b | a | b | c | b |
| Thickness (mm) | 0.5 | 1.2 | 1.2 | 1.2 | 1.6 |
| Hardness (a) (Shore D) | 40 | 20 | 40 | 50 | 40 |
| (Cover) | | | | | |
| Composition | I | I | I | III | IV |
| Thickness (mm) | 1.2 | 1.2 | 1.2 | 1.2 | 1.2 |
| Hardness (b) (Shore D) | 65 | 65 | 65 | 55 | 68 |
| Difference (b−a) | 25 | 45 | 25 | 5 | 28 |

TABLE 5

| Test item | Comparative Example No. 1 | 2 | 3 | 4 | 5 |
|---|---|---|---|---|---|
| (Core) | | | | | |
| Composition | D | D | E | F | C |
| Diameter (mm) | 38.0 | 38.0 | 38.0 | 38.0 | 38.0 |
| (Intermediate layer) | | | | | |
| Composition | d | d | d | b | c |
| Thickness (mm) | 1.2 | 1.2 | 1.2 | 1.2 | 1.2 |
| Hardness (a) (Shore D) | 38 | 38 | 38 | 40 | 50 |
| (Cover) | | | | | |
| Composition | I | II | IV | V | III |
| Thickness (mm) | 1.2 | 1.2 | 1.2 | 1.2 | 1.2 |
| Hardness (b) (Shore D) | 65 | 68 | 55 | 66 | 40 |
| Difference (b−a) | 27 | 30 | 17 | 26 | −10 |

TABLE 6

| Test item | Example No. 1 | 2 | 3 | 4 | 5 |
|---|---|---|---|---|---|
| Deformation amount (mm) | 3.10 | 3.25 | 3.15 | 3.30 | 3.00 |
| Coefficient of restitution | 103 | 101 | 102 | 100 | 103 |
| Flight performance (W#1; 40 m/sec) | | | | | |
| Launch angle (degree) | 10.8 | 10.9 | 10.9 | 10.7 | 10.7 |
| Spin amount (rpm) | 2780 | 2850 | 2880 | 2900 | 2800 |
| Flight distance | 103 | 101 | 101 | 100 | 103 |
| Durability | 105 | 110 | 108 | 120 | 100 |

TABLE 7

| Test item | Comparative Example No. 1 | 2 | 3 | 4 | 5 |
|---|---|---|---|---|---|
| Deformation amount (mm) | 3.15 | 3.08 | 3.35 | 2.98 | 3.40 |

TABLE 7-continued

| Test item | Comparative Example No. 1 | 2 | 3 | 4 | 5 |
|---|---|---|---|---|---|
| Coefficient of restitution | 98 | 99 | 97 | 99 | 97 |
| Flight performance (W#1; 40 m/sec) | | | | | |
| Launch angle (degree) | 10.6 | 10.5 | 10.5 | 10.6 | 10.4 |
| Spin amount (rpm) | 2950 | 2880 | 3050 | 2920 | 3300 |
| Flight distance | 99 | 99 | 97 | 99 | 96 |
| Durability | 95 | 90 | 99 | 80 | 120 |

As is apparent from Tables 6 and 7, the golf balls of Examples 1 to 5 of the present invention, when compared with the golf balls of Comparative Examples 1 to 5; had large coefficient of restitution, excellent flight distance, and excellent durability.

On the other hand, in the golf balls of Comparative Examples 1 to 3, since polyester-based thermoplastic elastomer unmodified by functional group is used as a base resin for the intermediate layer, the adhesion between the intermediate layer and cover is not sufficiently obtained. Therefore, the coefficient of restitution is small, which reduces the flight distance. In addition, the durability is poor.

In the golf ball of Comparative Example 4, since the resin having no polar site that can react with the functional group of the functional group modified resin in the intermediate layer as a base resin for the cover is used, the adhesion between the intermediate layer and cover is not sufficiently obtained. Therefore, the coefficient of restitution is small, which reduces the flight distance. In addition, the durability is poor.

In the golf ball of Comparative Example 5, since the intermediate layer hardness is higher than the cover hardness, the durability is excellent, but the spin amount is large, and the coefficient of restitution is small, which reduces the flight distance.

What is claimed is:

1. A multi-piece solid golf ball comprising a core, an intermediate layer formed on the core and a cover covering the intermediate layer, wherein the intermediate layer is formed from an intermediate layer composition comprising a functional group modified resin as a main component, the cover is formed from a cover composition comprising a resin having polar site that can react with the functional group of the functional group modified resin in the intermediate layer as a main component, and a hardness of the intermediate layer is lower than that of the cover.

2. The multi-piece solid golf ball according to claim 1, wherein the functional group modified resin is a functional group modified polyester-based thermoplastic elastomer.

3. The multi-piece solid golf ball according to claim 1, wherein the functional group of the functional group modified resin is selected from the group consisting of isocyanate group, epoxy group, acid group, hydroxyl group and anhydride group.

* * * * *